US008678704B1

(12) United States Patent
Smith et al.

(10) Patent No.: US 8,678,704 B1
(45) Date of Patent: Mar. 25, 2014

(54) INTERLOCKING REVETMENT BLOCK WITH TAPERED SURFACE

(71) Applicants: Lee A. Smith, Houston, TX (US); James S. Kole, Jr., Houston, TX (US); James R. DeShaw, Huntsville, TX (US)

(72) Inventors: Lee A. Smith, Houston, TX (US); James S. Kole, Jr., Houston, TX (US); James R. DeShaw, Huntsville, TX (US)

(73) Assignee: Erosion Prevention Products, LLC, South Houston, TX (US)

( * ) Notice: Subject to any disclaimer, the term of this patent is extended or adjusted under 35 U.S.C. 154(b) by 0 days.

(21) Appl. No.: 13/797,022

(22) Filed: Mar. 12, 2013

(51) Int. Cl.
*E02B 3/14* (2006.01)

(52) U.S. Cl.
USPC ..... 405/17; 405/16; 405/25; 405/33

(58) Field of Classification Search
USPC ..... 405/15–17, 20, 21, 25, 29, 30, 33
See application file for complete search history.

(56) References Cited

U.S. PATENT DOCUMENTS

| | | | | | |
|---|---|---|---|---|---|
| 1,164,707 | A | | 12/1915 | Edinger | |
| 1,164,708 | A | | 12/1915 | Edinger | |
| 1,561,796 | A | | 11/1925 | Rehbock | |
| 2,171,560 | A | | 9/1939 | Holmes et al. | |
| 3,347,048 | A | | 10/1967 | Brown et al. | |
| 3,854,291 | A | | 12/1974 | Perkins | |
| 4,269,537 | A | * | 5/1981 | O'Neill | 405/29 |
| 4,352,593 | A | | 10/1982 | Iskra et al. | |
| 4,465,398 | A | | 8/1984 | Knudsen | |
| 4,813,812 | A | | 3/1989 | Hasegawa et al. | |
| 4,856,934 | A | * | 8/1989 | Nelson | 405/33 |
| 4,978,247 | A | * | 12/1990 | Lenson | 405/15 |
| 5,020,938 | A | * | 6/1991 | Scales | 405/16 |
| 5,544,973 | A | | 8/1996 | Frizell et al. | |
| 5,556,228 | A | * | 9/1996 | Smith | 405/16 |
| 6,079,902 | A | * | 6/2000 | Pettee, Jr. | 405/35 |
| 6,267,533 | B1 | * | 7/2001 | Bourg | 405/16 |

* cited by examiner

*Primary Examiner* — Tara M. Pinnock
(74) *Attorney, Agent, or Firm* — Roger N. Chauza, P.C.

(57) ABSTRACT

A revetment block with a top surface that is tapered upwardly from the upstream end to the downstream end. Thus, when a number of tapered blocks are installed end to end on a grade, the upstream end of any of the blocks can be raised due to underlying ground irregularities without degrading the safety factor of the blocks. The tapered revetment blocks can also be constructed with positive interlocking arms and sockets to enhance the integrity of a matrix of such blocks.

19 Claims, 3 Drawing Sheets

INTERLOCKING REVETMENT BLOCK WITH TAPERED SURFACE

TECHNICAL FIELD OF THE INVENTION

The present invention relates in general to revetment blocks for controlling erosion, and more particularly to revetment blocks providing high safety factors.

BACKGROUND OF THE INVENTION

Revetment blocks are available in a variety of shapes and sizes for use in different applications. The erosion of ground surfaces can be controlled by installing heavy revetment blocks on the surface, generally on top of a geotextile filter fabric. The areas to be protected are those where there is substantial water flow, with a significant velocity. This includes watershed areas, channels, spillways, etc., where there either is a continuous flow of water, a periodic flow of water due to heavy rains or floods, or other areas where any erosion of the soil would be undesirable and detrimental.

The areas to be protected from erosion are generally graded to make the surfaces level, and then compacted. The graded surfaces can be inclined, such on the sides of a river bank or water shed area, or level such on the bed of a river or other area. Sheets or rolls of the geotextile material are then laid on the graded surface. Lastly, the revetment blocks are installed on the geotextile material either by hand, or in 8 foot up to 40 foot mats cabled together, depending on the specifications required of the project. The revetment blocks can be of the positive interlocking type such as disclosed in U.S. Pat. Nos. 5,556,228; 6,955,500; 8,123,434 and 8,123,435. Some of the blocks known in the prior art are shaped so that a portion of one block overlies a portion of the neighbor block to provide stability. The disadvantage with this type of block is that if one block breaks and requires replacement, one or more of the neighbor blocks are required to be manually lifted so that a portion of the replacement block can be slipped thereunder. Other blocks are positive interlocking, such as described in U.S. Pat. No. 5,556,228, so that each block can be lifted vertically and removed from the matrix without disturbing the neighbor blocks.

The effectiveness of revetment blocks to control the erosion of the underlying soil is a primary concern to those who select the type of block to be used. Because of the shape, weight and cost of revetment blocks, some blocks can better protect the underlying soil than other blocks. Another factor to take into consideration in the selection of a revetment block for a particular application, is the safety factor. The safety factor relates to the ability of the revetment block to withstand high velocity of water without lifting due to hydraulic forces. A matrix of revetment blocks having a smooth top surface has a high safety factor, as there are no frontal edges that the high velocity water can abut against and cause a lifting force to be exerted on the block. The water abutting against any frontal vertical edge of a revetment block exerts a lifting force as the water hits the frontal edge and rises to run over the top of the block. If the revetment block experiences a sufficient lifting force, it can be lifted out of place in the matrix and carried downstream. When this occurs, the integrity of the matrix is compromised, whereupon the neighbor blocks are more easily lifted and removed from the matrix also. Depending on the velocity and depth of the water flowing over the matrix, this chain reaction can continue until many or all of the revetment blocks are carried downstream. The erosion of the underlying soil is then unabated.

The safety factor of revetment blocks can be calculated by well known formulas which take into consideration the expected maximum velocity of water, the depth of water flowing over the matrix of revetment blocks, the grade or angle on which the revetment blocks are installed, the extent of disruption between neighbor blocks (surface unevenness), etc. The safety factor can be a numerical value between zero and upwardly to ten, or higher. A safety factor of zero means that there is a very high probability that the block will fail, and a high safety factor means that there is a low likelihood that the block will fail when subjected to worst case water flow. Generally, a minimum safety factor of about 1.9-2.0 is acceptable to most installation specifications to minimize liability and provide a sufficient degree of comfort that a mat or matrix of blocks will perform as expected based on the worst case conditions.

An acceptable safety factor can generally be achieved even with a vertical mismatch between neighbor blocks of about 0.5 inch. In other words, in order for a revetment block to achieve an acceptable safety factor, the vertical difference in height between any adjacent connected block cannot be more than 0.5 inch. If this is the worst case condition, the water will abut against the frontal edge of the downstream block and exert a lifting force, but the block will remain in place. A difference in the height of the side edges on the neighbor blocks is also a concern, as the hydraulic lifting force thereon is also exposed due to the uneven edges. Even when all of the revetment blocks are constructed with uniform thicknesses, the top surfaces or edges thereof may not provide a uniform smooth surface for the matrix. This can occur when the underlying soil is not sufficiently smooth, which is often the case. Even though the soil is graded and made as smooth as possible prior to the installation of the revetment blocks thereon, in practice there may be irregularities and undulations in the surface of the soil. Even if the soil is prepared with a very smooth surface and the blocks installed thereon, after a period of time, the soil can settle or fine soil particles can be carried away, thereby leaving an irregular surface on which the blocks rest. Revetment blocks are often used in application where the soil is characterized as being dispersive, or where differential settlement occurs. Such applications include landfills and coal mines. With regard to landfills, as the materials compost and otherwise deteriorate and degrade, the soil collapses and results in nonuniform surfaces. Coal mines are filled with earth material after being mined out, thus allowing areas to settle in a nonuniform manner. Thus, even if the revetment blocks are installed so that the surface underlying each block is even, this situation does not often remain over time. Accordingly, as time goes on, the block edges become uneven and the safety factor is effectively lowered.

From the foregoing, it can be seen that a need exists for a revetment block that exhibits an acceptable safety factor even when edge differences approach the industry standard of 0.5 inch. Another need exists for a revetment block that includes a purposeful difference in the height between neighbor block edges, at the interface between upstream and downstream edges, as well as the side-to-side edges. The frontal edge of the downstream block is made thinner than the back edge of the upstream block. Yet another need exists for a revetment block that is positive interlocking, i.e., having arms and sockets, and is constructed with a built-in mechanism that allows differences in surface irregularities to exist without adversely affecting the safety factor.

SUMMARY OF THE INVENTION

In accordance with the principles and concepts of the invention, there is disclosed a revetment block that has a top surface that is tapered upwardly from the upstream end to the downstream end. When placed adjacent to similarly-constructed neighbor blocks, the matrix of blocks is more tolerant to projections or irregularities in the underlying ground, while yet achieving a favorable safety factor.

In accordance with another feature of the invention, the tapered revetment block can be constructed so as to provide positive interlocking with neighbor blocks, such that the interlocked blocks cannot be separated laterally from each other, without first lifting one block vertically from the neighbor blocks.

According to yet another feature of the invention, the taper of the top surface of the revetment block ends where the downstream arm is attached to the side surface of the block, and the top surface of the downstream arm continues with the same degree of taper to the end of the downstream arm.

According to an embodiment of the invention, disclosed is an interlocking revetment block, which includes a body having a top surface and a bottom surface, and an upstream end and a downstream end. The top surface of the revetment block has at least a portion that is tapered upwardly toward a downstream end of the revetment block. The downstream end has attached to the body of the block one of an interlocking arm or an interlocking socket. The upstream end of the revetment block has attached to the body one of an interlocking arm or an interlocking socket.

According to another embodiment of the invention, disclosed is an interlocking revetment block that includes a body having a top surface and a bottom surface, an upstream end and a downstream end, and opposing side edges. The top surface is tapered upwardly from an upstream end of the revetment block to a downstream end where the tapered top surface terminates at a downstream edge. The downstream end has attached to the body of the block an interlocking arm. The upstream end has formed in the body of the block an interlocking socket. One side edge of the revetment block has one of an interlocking arm or an interlocking socket, and an opposite side edge of the block has one of an interlocking socket or an interlocking arm. The interlocking arm attached to the body of the block at the downstream end has a tapered top surface. The downstream edge has a vertical component that connects the top tapered surface of the revetment block to the top tapered surface of the downstream interlocking arm. A thickness of the interlocking arm that is connected to the downstream end of the block varies in the same degree as the thickness of the interlocking socket connected to the body at the upstream end of the block.

According to a further embodiment of the invention, disclosed is a method of installing interlocking revetment blocks. The method includes installing a first revetment block with a tapered top surface over a surface to be protected from erosion, where the revetment block is constructed with one or more interlocking arms and one or more interlocking sockets. The first revetment block is installed with the top surface tapered upwardly from an upstream direction to a downstream direction. A second similarly-constructed revetment block is lowered downwardly into engagement with the first revetment block so that no portion of the second revetment block overlies any portion of the first revetment block, and so that no portion of the first revetment block overlies any portion of the second revetment block, and so that the first and second revetment blocks cannot be laterally separated from each other.

BRIEF DESCRIPTION OF THE DRAWINGS

Further features and advantages will become apparent from the following and more particular description of the preferred and other embodiments of the invention, as illustrated in the accompanying drawings in which like reference characters generally refer to the same parts, functions or elements throughout the views, and in which.

DETAILED DESCRIPTION OF THE INVENTION

Figure 1:
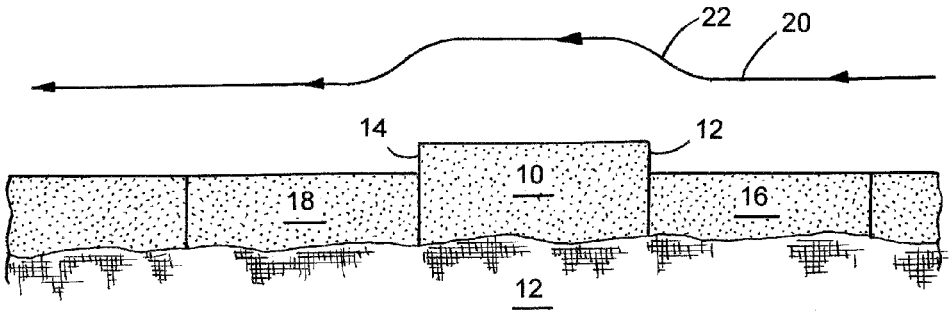
FIG.1 (PRIOR ART)
FIG. 1 is an illustration of a matrix of revetment blocks, and the characteristics of hydraulic forces caused by the water flow thereover.

With reference to FIG. 1, there is illustrated a side view of a matrix of revetment blocks, with block 10 elevated above the other blocks because of irregularities in the underlying surface of the ground 12. Because the block 10 is elevated, as compared to upstream neighbor block 16 and downstream neighbor block 18, there exists an exposed frontal edge 12 and a back edge 14 of block 10. The water flow over the matrix of blocks is shown by arrow 20.

It can be seen that as the water 20 flows over the matrix of revetment blocks, it is generally a laminar or straight flow until it encounters the frontal edge 12 of the elevated block 10. At this location, the vector of the water force on the block 10 has an upward component, shown by numeral 22. This is because as the water 20 is forced from a lateral flow and then upwardly at the frontal edge 12, a corresponding upwardly directed hydraulic force is exerted on the frontal part 12 of the block 10. The more the frontal edge 12 is exposed to the oncoming force of the water 20, the greater the upwardly directed hydraulic force. Depending on the area of the exposed frontal edge 12, and the velocity and depth of the water 20, there can be sufficient upward force to lift the frontal portion of the block 10 out of engagement with the neighbor block 16. When this occurs, the oncoming water flows under the block 10, which then exerts an upward force under the entire block 10. It is possible for the entire block 10 to be lifted from the matrix and carried downstream. When there begins to be voids in the matrix of revetment blocks, others will slide laterally to fill the vacancy until the entire matrix is destroyed. With positive interlocking erosion control blocks, the advantage is that the blocks cannot move laterally when they are interlocked together. The only way for a positive interlocking revetment block to be dislodged from the matrix is to be lifted vertically out of its interlocking engagement with the four neighbor blocks.

As the water 20 flows over the matrix of revetment blocks, as illustrated in FIG. 1, the water 20 flows downwardly over the back edge 14 of the block 10. The hydraulic forces at this location can be complex, but nevertheless there is less lift at the back edge 14, as compared to the frontal edge 12. Accordingly, because the back edge of the elevated block 10 is higher than the frontal edge of the downstream block 18, this is of little consequence as the safety factor is not substantially affected.

Figure 2A:
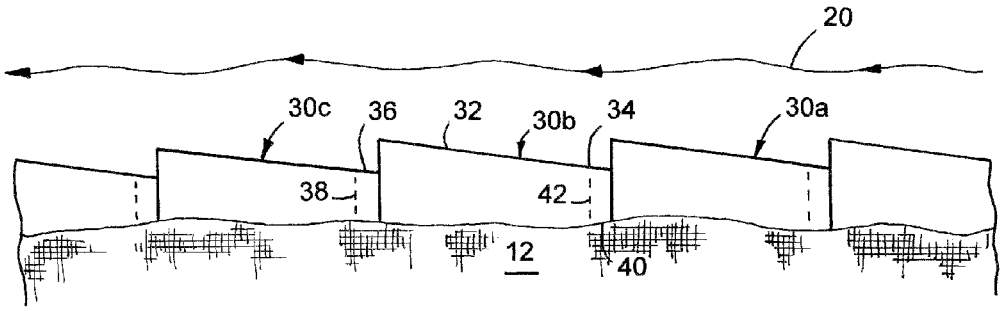
FIG. 2*a* is a side view of a portion of a matrix of tapered revetment blocks constructed according to an embodiment of the invention.

In accordance with a feature of the invention, disclosed is a revetment block that is constructed so that if or when the underlying ground becomes uneven or irregular, due to removal of soil, settling, or the like, the safety factor of the matrix is not compromised and thus the integrity thereof is maintained for longer periods of time and under more adverse conditions. The revetment block constructed according to the invention includes a tapered or slanted top surface, a level bottom surface and interlocking arms and sockets. The revetment block thus includes a thicker portion and a thinner portion. The revetment block according to the invention is installed with the thicker portion downstream, and the thinner portion upstream, as shown in FIG. 2*a*. Here, the revetment blocks 30*a*-30*c*, and others forming the matrix, include a downstream thicker portion 32 and a thinner upstream portion 34. The water 20 is flowing in the direction of the arrows.

Each revetment block, for example block 30*b*, also includes a downstream arm 36 that fits into a socket 38 of the downstream block 30*c*. The block 30*b* is constructed with an upstream socket 42 into which the arm 40 of the upstream block 30*a* fits. The positive interlocking arms and sockets will be described in more detail below. The revetment block 30*b* is constructed with other corresponding arms and sockets that fit into sockets and arms of neighbor blocks on each side (not shown) of the revetment block 30*b*. As can be seen from FIG. 2*a*, the water 20 flowing downstream over the matrix of revetment blocks 30 does not encounter abrupt vertical edges of any of the blocks, thus preserving the safety factor. Stated another way, the water flowing over the matrix of blocks 30 does not exert an upward lifting force that would tend to lift the blocks from their positions in the matrix, which would otherwise compromise the stability of the matrix.

Figure 2B:
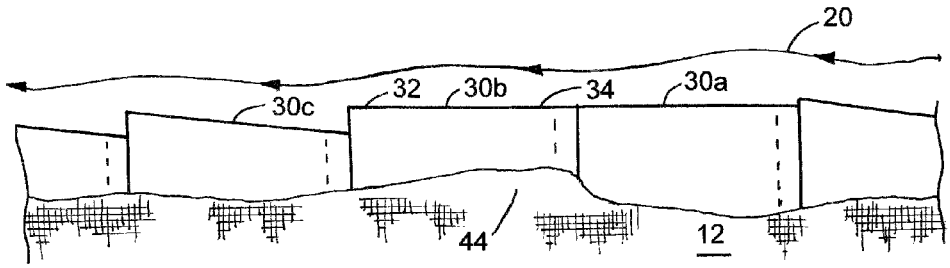
FIG. 2*b* is a side view of the matrix of tapered revetment blocks of FIG. 2*a*, but with a ground irregularity to show the safety factor of the block is not substantially diminished.

In the event that the underlying surface of the ground 12 becomes irregular, such as the raised bump 44 shown in FIG. 2*b*, the thinner upstream portion 34 raises to accommodate the ground irregularity. However, even when the thinner upstream portion 34 of block 30*b* is lifted, there is still no abrupt vertical edge into which the flowing water encounters to create a lifting force on the block 30*b*. This is because the top of the thinner portion 34 is still not above the thicker downstream portion of the upstream block 30*a*. It can be seen that if the difference in the thickness between the thinner downstream portion 32 and the thinner upstream portion 34 is, for example 0.5 inch, then the ground irregularity can be up to 0.5 inch before the safety factor of the block begins to be affected.

The revetment block 30 is constructed so that when the arms are interlocked within sockets of neighbor blocks, there is sufficient articulation between blocks to accommodate ground contours normally encountered or expected. As can be further appreciated, the difference in thickness of each of the tapered revetment blocks 30 can be determined or engineered as a function of the unevenness of the ground on which the blocks are to be installed. Thus, for each different installation, the blocks 30 can be engineered to guarantee a specified safety factor as a function of the unevenness of the ground. In addition, for ground characteristics that change over time, such as coal mines and landfills where the uniformity of the ground surface may be different over time, the revetment blocks 30 can be initially constructed to provide a safety factor based on the expected change over time. As noted above, a difference in the ground surface of about 0.5 inch is an industry standard by which safety factors are determined.

With reference back to FIG. 2*b*, in the event that the ground 12 changes such that the bump is formed under the thicker portion 32 of the revetment block 30*b*, then more of the downstream vertical face of the block 30*b* will be exposed, but the lifting vector of the water force will be less, and thus the safety factor will not be adversely affected.

Figure 3:
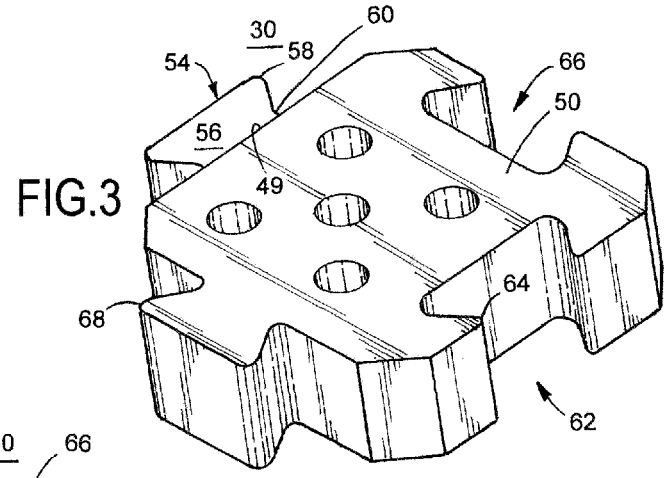
FIG. 3 is an isometric view of the tapered revetment block constructed according to an embodiment of the invention.
Figure 4:
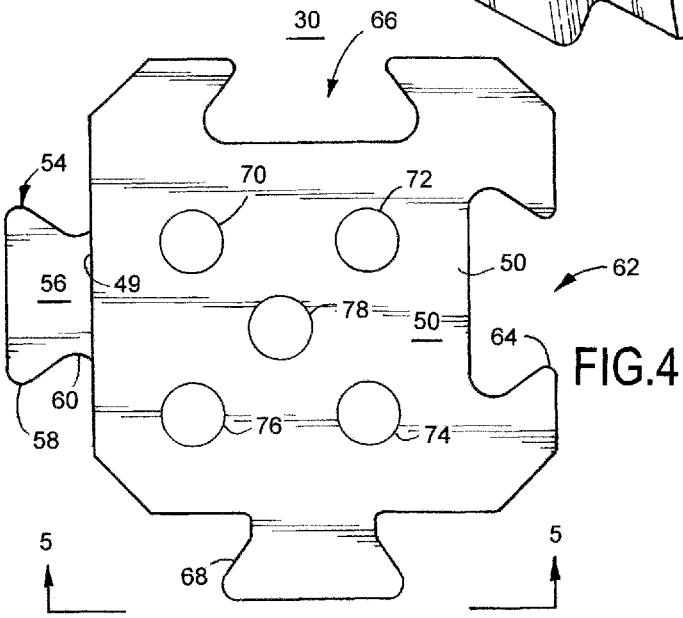
FIG. 4 is a top view of the tapered revetment block of FIG. 3.
Figure 5:
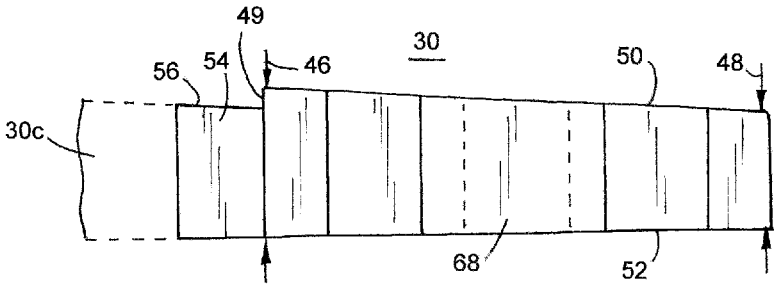
FIG. 5 is a side view of the tapered revetment block, as viewed from line 5-5 of FIG. 4.

With reference now to FIGS. 3-5, there is illustrated the tapered revetment block 30 constructed according to one embodiment of the invention. The block 30 can be constructed with concrete using block plant or wet cast techniques. The dimensions of the tapered revetment block 30 are not critical, but in the preferred embodiment the footprint is about 17.5 inches by 17.5 inches. The block has a tapered or sloped top surface 50 and a flat or level bottom surface 52. The thicker downstream end 46 of the block 30 is about 5.0 inches thick, and the thinner upstream end 48 is about 4.5 inches thick, as shown in FIG. 5. The amount of taper of the top surfaces of the block 30 is about 1.9 degrees. The overall weight of the tapered revetment block 30 is between about 65-70 pounds.

The tapered revetment block 30 is constructed with a downstream arm 54 that includes a top surface 56 that is tapered or sloped with the same angle as the top surface 50 of the block 30. The arm 54 includes an enlarged part 58 connected to the side edge of the block 30 by a narrowed portion 60. The upstream end 48 of the block 30 includes a socket 62 having a narrowed inlet 64 formed into the body of the block 30, and the socket 62 includes a top surface that is sloped and coplanar with the top surface 50 of the revetment block 30. A similar socket 66 is formed in an adjacent side of the block 30. A second arm 68 is formed in the block 30 opposite the socket 66. Thus, there is a respective socket formed in the side of the block 30 opposite each arm. The downstream arm 54 of the revetment block 30 fits within a socket of a similarly-constructed downstream block. The upstream socket 62 receives therein a downstream arm of a similarly-constructed upstream block. The socket 66 of the block 30 receives therein an arm of a similarly-constructed neighbor block. Lastly, the arm 68 of the block 30 fits within a socket of a similarly-constructed neighbor block. As can be appreciated, the tapered revetment block 30, as well as the four similarly-constructed neighbor blocks, are installed by lowering the blocks down into the arms/sockets of the neighbor block(s). As such, the blocks 30 of the matrix cannot be removed by lateral movement, but only by lifting the blocks vertically out of interlocking engagement with the neighbor blocks.

As noted above, the top surface 50 of the block 30 is tapered upwardly from the upstream end 48 to the downstream end 46. The downstream end 46 of the tapered top surface 50 terminates at a transition edge 49 that drops down about 0.5 inch to the upstream end of the interlocking arm 54. The downstream arm 54 is also tapered with the same angle. Moreover, the change in thickness in the downstream arm 54 is the same as that of the upstream socket 62 so that when the downstream arm 54 of the tapered revetment block 30 is engaged within the upstream socket of the neighbor block, a uniform tapered surface between the two engaged blocks is achieved. This can be seen in left of FIG. 5 where the arm 54 of the block 30 is engaged in the socket of the block 30*c* (partially shown in broken lines), and the top tapered surfaces of both blocks are uniform and angled the same. It can be appreciated that each of the two top surfaces 50 and 56 of the revetment block 30 is tapered, and tapered to the same degree. However, the degree of taper in the top surfaces 50 and 56 of the block 30 can be different from that described above.

The tapered revetment block 30 is also constructed by forming five holes therethrough from the top surface 50 to the bottom surface 52. The holes function to allow vegetation to grow therein and assist in anchoring the block 30 to the underlying ground. The specific spacing and hole size can also improve the hydraulic characteristics of the revetment block 30. There are four holes 70, 72, 74 and 76 formed in the respective corners of a virtual square. A fifth hole 78 is formed in the middle of the virtual square. The diameter of each hole is about 2.0 inches, and the center of each of the four holes 70, 72, 74 and 76 is about 4.0 inches from the center of the central hole 78. The holes can be formed with different sizes and at different locations in the block according to the description of U.S. Pat. No. 8,123,435 entitled "Interlocking Revetment Block With Array of Vegetation Holes."

Figure 6:
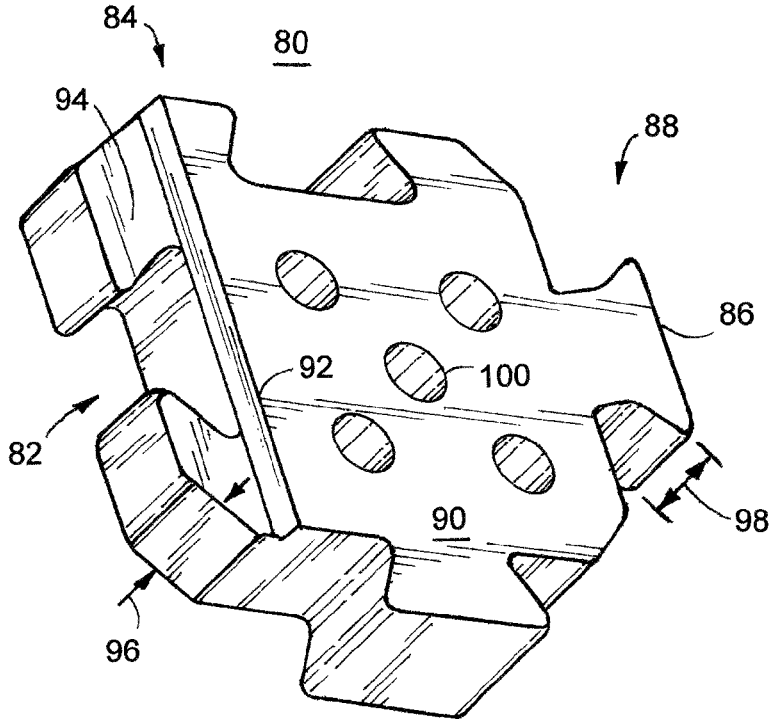
FIG. 6 is a top view of a revetment block constructed according to another embodiment of the invention.

FIG. 6 illustrates a revetment block 80 constructed according to another embodiment of the invention. In this embodiment, the block 80 is fabricated with a socket 82 at a downstream end 84 and an arm 86 at the upstream end 88. The top surface 90 of the revetment block 80 tapers upwardly from the upstream end 88 to the downstream end 84, and stops at the discontinuity or transition edge 92. The discontinuity 92 at the downstream end 84 of the top surface 90 makes a downwardly transition to the top surface 94 of the downstream socket 82. The discontinuity 92 can be a vertical difference of about 0.5 inch or other suitable dimension. At the discontinuity 92, the top surface 94 of downstream socket 82 tapers upwardly to the end of the block 80. The tapered thickness 96 of the downstream socket 82 is the same tapered thickness 98 of the upstream arm 86. Thus, when the tapered arm of a similarly-constructed revetment block is inserted into the tapered socket 82 of the illustrated revetment block 80, and both are on level ground, the top surfaces are coplanar, but taper upwardly together in a downstream direction. Otherwise, the block 80 functions hydraulically in a manner substantially identical to the block 30 described above.

The revetment block 80 is constructed with five holes therethrough, one shown as numeral 100. However, the block 80 could be fabricated with any number of holes, with shapes and locations on the block other than shown.

Figure 7:
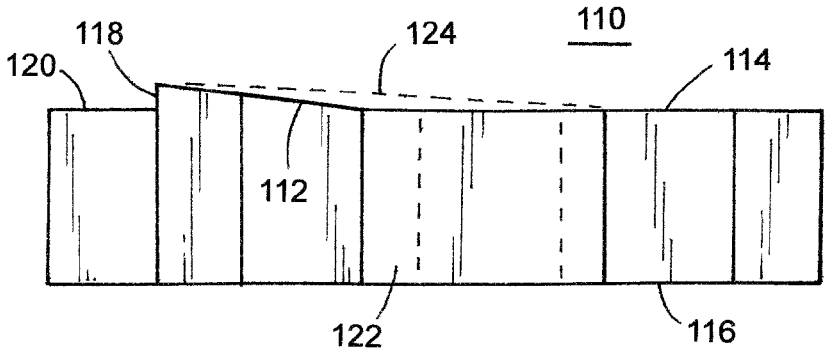
FIG. 7 illustrates yet another embodiment of a revetment block constructed according to the invention.

FIG. 7 illustrates yet another embodiment of a tapered revetment block 110 of the type having a downstream interlocking arm and an upstream interlocking socket. The block 110 is constructed with a portion of the top surface 112 that is tapered, and a portion 114 that is flat and not tapered. The bottom surface 116 is flat and parallel to the top flat surface 114. As with the other embodiments described above, the tapered top surface 112 terminates in an edge 118 that forms a transition to the downstream interlocking arm 120. In this embodiment, the top surface of the interlocking arm 120 is flat like the top flat surface 114 of the block 110. In addition, the thickness of the downstream interlocking arm 120 is uniform and is the same as the thickness of the top flat surface 114. It can be appreciated that the top flat surface 114 of the block 110 is also the top surface of the upstream interlocking socket.

Because at least a portion of the top surface 112 is tapered upwardly from upstream to downstream, the raised edge 118 allows a certain degree of nonuniformity of the ground surface to exist under the downstream neighbor block without degrading the safety factor. The revetment block 110 is constructed with an interlocking arm 122 on a side edge, and an interlocking socket on the opposite side edge. As an alternative, the top tapered surface of the revetment block 110 can begin at the downstream end of the upstream interlocking socket 116, such as shown by the broken line 124. As can also be appreciated, the revetment block 110 can be constructed with similar tapered surfaces, but with a downstream interlocking socket and an upstream interlocking arm.

While the tapered revetment blocks are described in connection with a preferred and other embodiments, the blocks need not include vegetation holes, nor arms and sockets. Alternatively, the tapered revetment block could be constructed to have only an upstream socket and a downstream arm and no side arms or sockets. The tapered revetment block could also be constructed with only an upstream arm and a downstream socket, with side arms and sockets, or no side arms or sockets. If the tapered revetment blocks are constructed with no side arms or sockets, cable channels could be formed therethrough to provide side-to-side stability when cabled together in a mat. As a further alternative, the various tapered revetment blocks could have cable channels formed therethrough both laterally and upstream-downstream to provide additional stability and the ability to cable a mat of blocks together and install the same by a crane in underwater applications.

From the foregoing, disclosed is a revetment block that is tapered from the upstream end to the downstream end so that when installed side by side, a shingled appearance results. However, no part of one block underlies any portion of another block that would otherwise make replacement of a block troublesome. The tapered revetment block has built therein a mechanism such that if the upstream end rises due to an irregularity in the underlying ground, the upstream end still does not project above the downstream end of the neighbor block. The raised upstream end thus does not create a vertical side to which oncoming water can abut and produce a lifting force. Accordingly, the safety factor of the block is not degraded due to irregularities in the ground on which the revetment blocks are installed, or which appear after installation of the blocks on an otherwise smooth ground surface. The projection tolerance of the tapered revetment block is thus enhanced. While the top surface of the revetment block is illustrated as a tapered smooth surface, the top surface could have formed therein a roughened surface with lined indentions or other roughening shapes. In addition, the top surface could be formed with a taper having a slight curvature from the upstream end to the downstream end, either concave or convex.

From the foregoing, described are various embodiments of interlocking tapered surface revetment blocks. A advantage of the revetment blocks of the invention is that they can be installed starting from one end of the project and proceeding to the other end, or vice versa. The easy replacement of an individual revetment block of a matrix is especially important when vegetation grows through the holes and firmly anchors each of the blocks to the ground. In addition, with positive interlocking arms and sockets, the lateral integrity of a matrix of blocks is greatly enhanced.

While the preferred and other embodiments of the invention have been disclosed with reference to specific tapered revetment blocks, and associated methods thereof, it is to be understood that many changes in detail may be made as a matter of engineering choices without departing from the spirit and scope of the invention, as defined by the appended claims.

What is claimed is:

1. An interlocking revetment block, comprising:

a body of the revetment block that includes a top surface and a bottom surface, said body having a thickness between said top surface and said bottom surface, and said body having an upstream end and a downstream end;

the thickness of said body varying such that said top surface has at least a portion that is sloped upwardly with respect to said bottom surface toward a downstream end of the body of said revetment block;

the body of said revetment block having at least two interlocking members comprising at least one interlocking arm and at least one interlocking socket;

said downstream end of the body of said revetment block having attached thereto a downstream said interlocking member;

said upstream end of the body of said revetment block having attached thereto an upstream said interlocking member;

said upstream interlocking member having a top surface that slopes upwardly with respect to a bottom surface thereof from an upstream end of said upstream interlocking member to a downstream end thereof;

said downstream interlocking member having a top surface that slopes upwardly with respect to a bottom surface thereof from an upstream end of said downstream interlocking member to a downstream end thereof; and a varying thickness of said interlocking arm is the same as a varying thickness of said interlocking socket.

2. The interlocking revetment block of claim 1, wherein said revetment block further includes a second interlocking arm on a side edge thereof, and a second interlocking socket formed in a side edge opposite said second interlocking arm.

3. The interlocking revetment block of claim 1, wherein said downstream end of the body of said revetment block is about 0.5 inch thicker than said upstream end of the body of said revetment block.

4. The interlocking revetment block of claim 1, further including one or more vegetation holes formed in the body of said revetment block from the top surface to the bottom surface.

5. The interlocking revetment block of claim 1, wherein said revetment block comprises a downstream revetment block, and further including a similarly-constructed upstream revetment block, an interlocking member of said upstream revetment block is interlocked with the interlocking member of said downstream revetment block, and said interlocked interlocking members articulate so that the top surface of a downstream end of said upstream revetment block is at substantially the same elevation as the top surface of the upstream end of said downstream revetment block.

6. The interlocking revetment block of claim 5, wherein said upstream and downstream revetment blocks are constructed so that a position of the upstream end of the downstream block lying on a ground surface is independent of a position of the downstream end of the upstream block lying on a different elevation of the ground surface.

7. The interlocking revetment block of claim 1, wherein said revetment block comprises a downstream revetment block, and further including a similarly-constructed upstream revetment block, an interlocking member of said upstream revetment block is interlocked in the interlocking member of said downstream revetment block, and said upstream and said downstream revetment blocks are constructed so that when interlocked together, the upstream end of said downstream revetment block can move vertically upwardly without the downstream end of said upstream revetment block moving vertically.

8. The interlocking revetment block of claim 7, wherein said upstream and said downstream revetment blocks are constructed so that the top surface of the upstream end of said downstream revetment block can move upwardly to a same elevation as a top surface of the downstream end of the upstream revetment block.

9. The interlocking revetment block of claim 1, wherein said revetment block comprises a downstream revetment block, and further including a similarly-constructed upstream revetment block, an interlocking member of said upstream revetment block is interlocked in the interlocking member of said downstream revetment block, said upstream and downstream revetment blocks cannot be separated laterally while interlocked.

10. The interlocking revetment block of claim 1, wherein the sloped top surface of said body is not coplanar with the sloped top surface of said interlocking arm.

11. The interlocking revetment block of claim 10, wherein the sloped top surface of said downstream end of said revetment block includes a downstream transition edge that drops to the top sloped surface of said interlocking arm.

12. The interlocking revetment block of claim 1, wherein the top sloped surface of said body terminates at a downstream transition edge and drops to the sloped top surface of said downstream interlocking member by about 0.5 inches.

13. The interlocking revetment block of claim 1, wherein the sloped top surface of said body is not coplanar with the sloped top surface of said interlocking socket.

14. The interlocking revetment block of claim 1, wherein the sloped top surface of said body and the sloped top surface and said interlocking arm include a surface discontinuity therebetween.

15. The interlocking revetment block of claim 1, wherein the sloped top surface of said upstream interlocking member is coplanar with the sloped top surface of the body of the revetment block.

16. The interlocking revetment block of claim 15, wherein the sloped top surface of said downstream interlocking member is not coplanar with the sloped top surface of the body of said revetment block.

17. An interlocking revetment block, comprising:

a body of the revetment block, said body includes a top surface and a bottom surface, and includes an upstream end and a downstream end, said body further includes opposing side edges;

a thickness of said body varies so that said top surface slopes upwardly from an upstream end of said body to a downstream end of said body, said sloped top surface terminates at a downstream transition edge;

said downstream end having attached to the body of said block an interlocking arm;

said upstream end having formed in the body of said block an interlocking socket;

one said side edge of said body having one of an interlocking arm or an interlocking socket, and an opposite said side edge of said body having one of an interlocking socket or an interlocking arm;

said interlocking arm attached to the body at said downstream end having a sloped top surface, and said downstream transition edge has a vertical component that connects the sloped top surface of said body to the sloped top surface of the interlocking arm connected to said downstream end of said body; and a thickness of the interlocking arm that is connected to the downstream end of said body varies in the same degree as a thickness of the interlocking socket formed in the body at the upstream end.

18. A method of installing sloped interlocking revetment blocks, comprising:

installing a first revetment block with a body having a sloped top surface, and installing the first revetment block over a surface to be protected from erosion, using said first revetment block that is constructed with at least an upstream interlocking member and a downstream interlocking member, and each said interlocking member comprises either an interlocking arm with a sloped top surface or an interlocking socket with a sloped top surface;

installing the first revetment block with the top surface of the body sloped upwardly from an upstream direction to a downstream direction, and so that the sloped top surface of the upstream interlocking member is coplanar with the sloped top surface of the body of the first revetment block; and lowering a second revetment block, similarly constructed to said first revetment block, downwardly into interlocking engagement with the first revetment block so that:

1) the first and second revetment blocks are interlocked together and cannot be laterally separated from each other; and 2) the sloped top surface of the downstream interlocking member of the first revetment block is coplanar with the sloped top surfaces of both the body of the second revetment block and the upstream interlocking member of the second revetment block.

19. The method of claim 18, further including installing sloped interlocking revetment blocks so that no portion of the second revetment block overlies any portion of said first revetment block, and so that no portion of the first revetment block overlies any portion of said second revetment block.

* * * * *